United States Patent [19]

Johnson et al.

[11] Patent Number: 4,801,262

[45] Date of Patent: Jan. 31, 1989

[54] LOW VELOCITY AIR SEAL

[75] Inventors: Jeffrey C. Johnson, Birmingham; Maximilian K. Carthew, Rochester Hills, both of Mich.

[73] Assignee: Haden Schweitzer Corporation, Madison Heights, Mich.

[21] Appl. No.: 133,161

[22] Filed: Dec. 11, 1987

Related U.S. Application Data

[63] Continuation of Ser. No. 858,029, May 1, 1986, abandoned.

[51] Int. Cl.[4] ..... F27B 9/28; F24F 9/00

[52] U.S. Cl. ..... 432/8; 432/59; 432/64; 432/242; 98/36

[58] Field of Search ..... 98/36, 115.1–115.3; 432/242, 8, 59, 64; 110/179

[56] References Cited

U.S. PATENT DOCUMENTS

| | | | |
|---|---|---|---|
| 2,500,606 | 3/1950 | Dosmar | 98/36 |
| 2,544,769 | 3/1951 | Sperry et al. | 98/36 |
| 3,386,365 | 6/1968 | Jensen | 432/64 |
| 3,397,631 | 8/1968 | Simons | 432/64 |
| 3,533,245 | 10/1970 | Komberec et al. | 432/242 |
| 3,834,293 | 9/1974 | Danieli | 432/64 |
| 3,982,887 | 9/1976 | Kendziora et al. | 432/242 |
| 4,050,368 | 9/1977 | Eakes | 98/36 |
| 4,217,090 | 8/1980 | Whike et al. | 432/59 |
| 4,298,341 | 11/1981 | Nowack | 432/64 |
| 4,590,916 | 5/1986 | Konig | 432/242 |

FOREIGN PATENT DOCUMENTS

| | | | |
|---|---|---|---|
| 617668 | 7/1978 | U.S.S.R. | 432/64 |

*Primary Examiner*—Henry C. Yuen

*Attorney, Agent, or Firm*—Niro, Scavone, Haller, Niro & Rockey

[57] ABSTRACT

A low velocity oven seal for use with an elongated oven complex of the type in which articles to be processed are moved longitudinally through the oven. The seal includes an air seal compartment adapted to be aligned with the entry end of the oven complex to form a prefix to the oven complex. In one form of the invention, a blower assembly is mounted on the roof of the air seal compartment adjacent the exit end of the comparment and functions to withdrawn air from the upper region of the air seal compartment adjacent the exit end thereof for delivery to a pair of plenum chambers disposed at either side of the air seal compartment. The air delivered to the plenum chamber is introduced into the lower region of the air seal compartment generally below the path of the articles being processed within the oven complex and this air in turn moves upwardly and toward the exit of the air seal compartment where it is received by the inlet to the blower assembly to complete the air cycle. In another embodiment of the invention, the air is withdrawn from the upper region of the exit end of the air seal chamber by ducting which communicates with the existing exhaust ducting of the convection heating compartment of the oven and the air reintroduced into the air seal through the plenum chambers is supplied to the plenum chambers through ducting connecting with the existing air supply system of the convection heating compartment.

8 Claims, 2 Drawing Sheets

FIG. 1
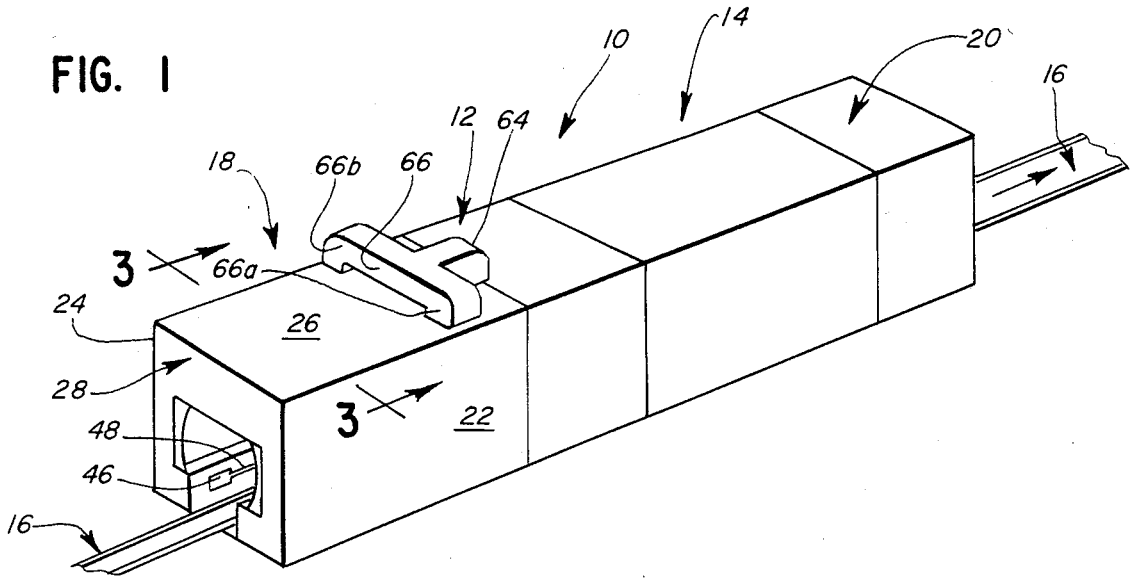
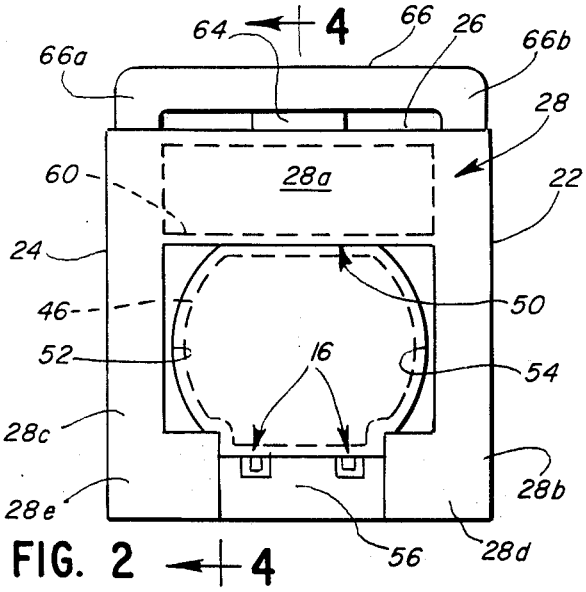
FIG. 2
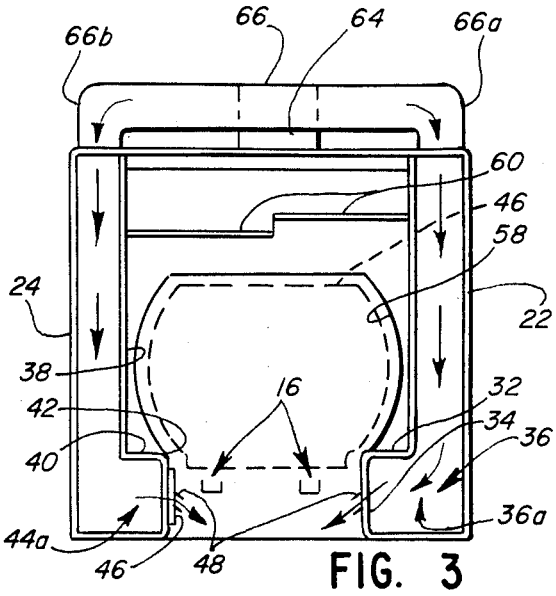
FIG. 3
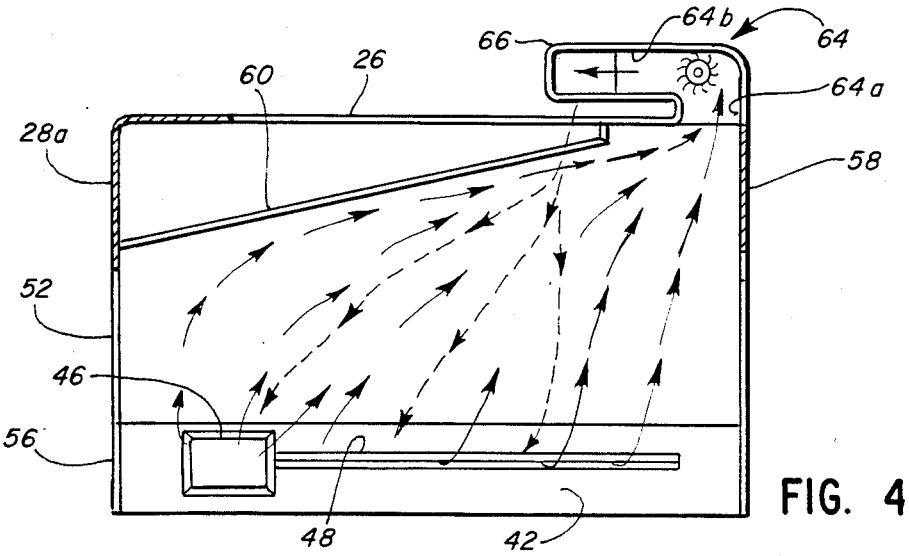
FIG. 4

LOW VELOCITY AIR SEAL

This is a continuation of co-pending application Ser. No. 858,029, filed on May 1, 1986, now abandoned.

BACKGROUND OF THE INVENTION

This invention relates to seals for oven systems of the type in which articles to be treated are moved longitudinally through successive zones of the oven system.

Elongated oven systems are in common usage in the automotive and other industries to dry articles following the application of a finish coat to the articles. The coated articles are typically moved longitudinally and continuously through the oven system, through radiant and/or convection zones, to accomplish a permanent setting and curing of the finish coat. Whereas these oven systems are generally satisfactory with respect to their ability to effectively cure the finish coat, they are energy inefficient and also tend to pollute the adjacent building environment.

Specifically, large amounts of heat energy are lost out of the open ends of the oven system by heated air escaping out of the open ends into the adjacent building, and the environment of the adjacent building is polluted since the escaping air contains fumes from the drying finish coat as well as other contaminants. This movement of air out of the open ends of the oven system occurs primarily as a rollover movement in which hot, relatively thin air escapes out of the upper region of the open end and cold dense air simultaneously moves into the lower region of the open end. It is therefore desirable to seal the open ends of these elongated oven complexes to preclude energy loss and preclude contamination of the adjacent environment.

In the past, sealing has been attempted by defining sealing compartments as a prefix or suffix to the oven proper in which the articles to be treated within the oven are passed through a low, narrow tunnel having dimensions just sufficient to pass the article. While these tunnels have been partially effective, they have still allowed significant amounts of energy and contaminants to escape from the oven.

Attempts have also been made to seal the open ends of the oven by the use of forced air blown into the open ends of the oven through adjustable nozzles positioned around the periphery of the open oven ends to achieve a direct frontal assault on the air attempting to escape the oven. Whereas these frontal attack systems have been effective in preventing the escape of the hot contaminated gases from the oven, they have served to stir up the air within the oven itself with the result that the as yet uncured paint often picks up the contaminants in the stirred up air with the result that the finish coat is significantly marred.

SUMMARY OF THE INVENTION

This invention is directed to the provision of a seal for an oven which prevents the escape of hot contaminated gases from the oven without significantly disturbing the air within the oven.

According to the invention, the seal comprises an air seal compartment adapted to be aligned with the entry to the associated oven to form a prefix to the oven with the exit of the compartment juxtaposed to the entry to the oven; means for withdrawing air from the upper region of the air seal compartment adjacent the compartment exit; and means for supplying air to the lower region of the air seal compartment. This arrangement has the effect of substantially eliminating the temperature gradient measured along the vertical dimension of the entrance to the air chamber to thereby substantially eliminate the prior art rollover movement of hot air out of the upper region of the entrance and simultaneous movement of cold air into the lower region of the entrance.

According to a further feature of the invention, the air supplied to the lower region of the air seal compartment is the air withdrawn from the upper region of the air seal compartment. This arrangement ensures that the air supplied to the lower region of the compartment is heated air since the air withdrawn from the upper region of the compartment adjacent the compartment entrance is relatively high temperature air by virtue of its elevated position within the compartment and by further virtue of its proximity to the oven entrance.

According to a further feature of the invention, the means for withdrawing air from the upper region of the air seal compartment comprises a fan communicating with that region and the means for supplying air to the lower region of the air seal compartment comprises ducting extending from the outlet of the fan to the lower region of the air seal compartment. This arrangement provides a simple and effective means of recirculating the heated air from the upper region of the compartment to the lower region of the compartment.

According to a further feature of the invention, the upper portion of the entrance to the air seal compartment is blocked to define a relatively low height opening therebelow, and the seal further includes means defining a ceiling panel sloping upwardly from the entrance of the air seal compartment to the exit of the air seal compartment. This sloping panel causes the hottest air in the compartment to migrate to the highest point in the compartment and away from the entrance to the compartment. The sloping panel thus discourages the escape of hot air from the entrance to the air seal compartment and funnels the hot air to the intake of the exhaust fan associated with the upper region of the air seal compartment.

According to a feature of a further embodiment of the invention, the seal is intended for use with an elongated oven having a convection drying zone; the air withdrawn from the upper region of the air seal compartment is ducted to the convection zone of the associated oven; and the air supplied to the lower region of the air seal compartment is ducted from the convection zone of the associated oven.

According to a further feature of this embodiment, the ducting for the air withdrawn from the upper region of the air seal compartment is connected to the exhaust air ducting system of the convection zone of the associated oven and the ducting for the air supplied to the lower region of the air seal compartment is connected to the air supply ducting system of the convection zone of the associated oven. This arrangement allows the utilization of existing exhaust and supply ducting to provide the desired movement of the air from the upper region of the air seal compartment to the lower region of that compartment.

BRIEF DESCRIPTION OF THE DRAWINGS

FIG. 1 is a perspective somewhat schematic view of an oven system employing the air seal of the invention;

FIG. 2 is a view taken in the direction of the arrow 2 in FIG. 1;

FIG. 3 is a cross sectional view taken on line 3—3 of FIG. 1;

FIG. 4 is a cross sectional view taken on line 4—4 of FIG. 2;

DETAILED DESCRIPTION OF THE PREFERRED EMBODIMENT

Figure 6:
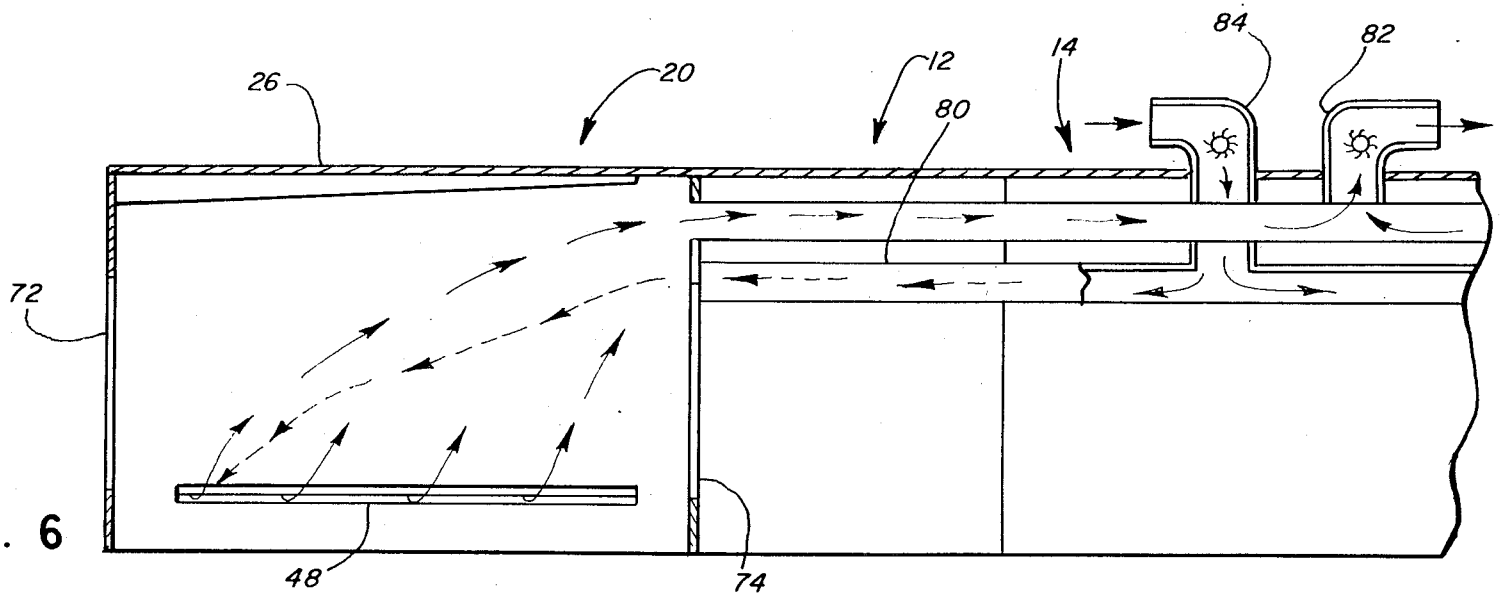
FIG. 6 is a cross sectional view taken on line 6—6 of FIG. 5.

A first embodiment of the invention air seal is seen in FIGS. 1-4.

As seen in FIG. 1, the invention air seal is intended for use with an elongated oven system of the type used for example in drying automotive bodies after the application of a finish coat to the bodies and in which the articles to be dry are moved continuously and longitudinally through the elongated oven complex. The oven system may comprise, for example, a radiant heat compartment 12 followed by a convection heat compartment 14 and floor mounted conveyor means 16 may be provided to move the articles through the oven complex.

The invention air seal is seen generally at 18. Air seal 18 includes an air seal compartment 20 including parallel side walls 22 and 24, a roof 26 and an entrance end panel 28. Air seal compartment 20 corresponds in cross-sectional size and configuration to radiant heat compartment 12 and convection compartment 14 and is adapted to be aligned with the entry to the radiant heat compartment to form a prefix to the oven assembly so that the exit of the compartment 20 coincides with the entrance to the radiant heat compartment 12.

Compartment 20 further includes a vertical interior panel 30, a horizontal interior panel 32 and a further vertical interior panel 34. Panels 30, 32 and 34 coact with side wall 22 of the air seal compartment to form an L-shaped plenum chamber 36 extending from top to bottom of the compartment and from the entrance to the exit of the compartment. In similar fashion, a vertical panel 38, a horizontal panel 40, and a further vertical panel 42 coact with side wall 24 to form an L-shaped plenum chamber 44 extending from top to bottom of the air seal compartment and from the entrance to the exit of the air seal compartment at the opposite side of the compartment from plenum chamber 36. Panels 34 and 42 are spaced apart laterally by an amount sufficient to accommodate the conveyor system 16 as well as a suitable carriage assembly (not shown) for supporting an automotive body (also not shown) and conveying the body through the oven complex. An air register 46 is positioned in each of the panels 34 and 42 adjacent the entrance to the air seal chamber and an adjustable slot structure 48 extends from register 46 to a region adjacent the exit of the air seal chamber.

Entrance end panel 28 includes an upper portion **28*a* blocking the upper portion of the entry end of the air seal compartment; vertical side portions 28*b* and 28*c* in substantial longitudinal alignment with the main body portions of plenum chambers 36 and 34, and lower portions 28*d* and 28*e* in substantial longitudinal alignment with the horizontally inwardly extending portions 36*a*, 44*a* of plenum chambers 36, 44. Panel portions 28*a*, 28*b*, 28*c*, 28*d*, and 28*e* coact to define an entrance opening 50 for passage of the automotive body, and the entrance opening is further defined by silhouette panels 52 and 54 at either side of opening 50 which are custom cut from sheet metal to conform to the cross sectional configuration of the particular automotive body being processed. A further silhouette panel 56, also custom cut from sheet metal, may also be provided in cooperation with the runs of conveyor system 16 to further customize the entry to the air seal chamber to match the specific outline of the particular vehicle body being processed. A further silhouette panel 58**, custom cut from sheet metal to match the particular configuration of the particular vehicle body being processed, is positioned within the exit end of the air seal passage.

A sloping, false ceiling panel 60 extends upwardly from the entrance of the air seal chamber to a location adjacent the exit of the air seal chamber. The lower end of panel 60 is positioned a short distance above the lower edge of end panel portion **28*a* and extends upwardly therefrom for coaction with a transverse ceiling panel 62** positioned adjacent to but spaced from the exit end of the air seal chamber.

A blower mechanism 64 is positioned on the roof of the air seal chamber adjacent the exit end of the chamber with its inlet **64*a* in communication with the upper region of the air seal compartment adjacent the exit end of that compartment, between ceiling panel 62 and silhoutte panel 58, and with its outlet 64*b* communicating with ducting 66 positioned on the roof of the air seal compartment and extending transversely of the air seal for communication at its opposite ends 66*a* and 66*b* with the upper ends of plenum chambers 36 and 44** respectively.

In the operation of the air seal of the FIGS. 1-4 embodiment, blower assembly 64 operates to suck air upwardly out of the upper region of the air seal compartment adjacent the exit end of the compartment. Blower assembly 64 moves this air through duct 66 and downwardly into plenum chambers 36 and 44 where the air moves downwardly within the plenum chamber and longitudinally within the chambers toward the entrance end of the air seal compartment for discharge through registers 46 and slots 48 at locations generally below the articles, such as automotive bodies, being passed through the oven system. Since warm air is being supplied to the plenum chambers, the air exiting the registers 46 and the slots 48 moves upwardly within the chamber air seal until it encounters the sloping panel 60 whereafter it moves upwardly along the panel toward the entrance **64*a* of blower assembly 64 where it begins a new cycle. This gentle air movement has the effect of substantially eliminating any temperature gradient measured along the vertical height of the opening 50 to the air seal, thereby substantially eliminating the prior art characteristic of warm air exiting the oven adjacent the open upper end of the oven and cold air simultaneously entering the oven adjacent the open lower end of the oven. That is, this substantial elimination of a temperature gradient as measured along the vertical height of the entrance to the air seal substantially prevents the rollover of air at the entrance to the air seal since the differences in air density causing this rollover effect have substantially been eliminated. The air in the air seal, after a period of operation, is near building ambient temperature at the entrance end of the air seal and near oven ambient temperature at the exit end. There is substantially no difference in air density as measured form top to bottom of the air seal however, especially at the entrance to the air seal, so that the driving force for hot air and fume leakage at the open end of the oven assembly is substantially eliminated. The sloping panel 60** causes the hottest air in the air chamber to migrate to the highest point of the air seal and away from the entry silhouette opening, thus further helping to prevent hot air and fume leakage from the open end of the oven assembly. The movement of the air within the air seal is generally low velocity and passive so that the wet surface finish on the automobile bodies passing through the air seal is not disturbed or marred by the air flow itself or by contaminants carried by the air flow. The invention air seal will thus be seen to minimize infiltration and exfiltration by providing a chamber of substantially constant air temperature from top to bottom. By minimizing temperature differences in the air seal, convection currents are reduced, thereby reducing the natural flow of warm air out of the oven and cold air in. It will be understood that the ducting size, blower assembly size, and blower assembly speed are selectively determined and regulated to achieve an air flow rate and pattern sufficient to substantially eliminate the vertical temperature gradient at the air seal entrance.

Figure 5:
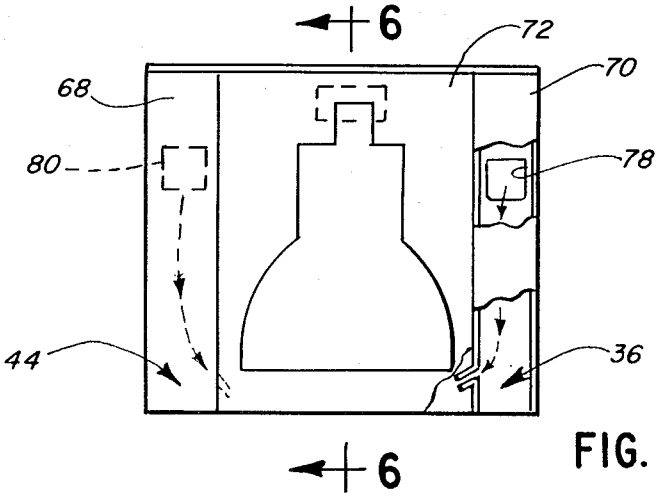
FIG. 5 is an entrance end view of a second embodiment of the invention air seal.

A second embodiment of the invention air seal is seen in FIGS. 5 and 6.

The air seal of FIGS. 5 and 6 is generally similar to the air seal of FIGS. 1–4 except that it is especially suitable for use with an overhead conveyor system as opposed to the floor mounted conveyor system utilized in the FIGS. 1–4 embodiment.

In the embodiment of FIGS. 5 and 6, sloping ceiling panel 60 is eliminated; front entry panel 28 is eliminated and replaced with two separate floor to ceiling panels 68 and 70 respectively longitudinally aligned with plenum chambers 36, 44; and the entrance and exits of the air chamber are provided with sheet metal silhouette panels 72 and 74 which are custom cut to accommodate an overhead conveyor and to accommodate the particular configuration of the particular automotive body being processed; registers 46 are eliminated in favor of extending the slots 48 substantially the full length of the plenum chambers; a central longitudinally extending duct 76 communicates with the upper region of the air seal compartment adjacent the exit end of the compartment; and a pair of laterally spaced, longitudinally extending ducts 78 and 80 communicate respectively with plenum chambers 36 and 44 at the exit end of the air seal chamber. Conduit 76 communicates at its other end with the existing exhaust air duct system 82 of the convection heating compartment 14 of the oven system and ducts 78 and 80 communicate at their other ends with the existing air supply duct system 84 of the convection heating compartment 14.

In the operation of the air seal of the FIG. 5 and 6 embodiment, heated air is withdrawn from the upper region of the air seal adjacent the air seal exit through conduit 76 and the air moving through conduit 76 enters the existing exhaust duct system 82 of the convection heating compartment for exhaust from the oven along with the exhaust air being withdrawn from the convection heating zone. At the same time, air is supplied to plenum chambers 36 and 40 through conduits 78 and 80 by the fresh air duct system 84 of the convection heating zone. The air entering the plenum chambers 36 and 40 moves downwardly and toward the entrance end of the air seal compartment for discharge through slots 48. The air leaving slots 48, in a manner similar to the manner described with reference to the embodiments of FIGS. 1–4, flows upwardly and away from the entrance to the air seal to the upper region of the exit end of the air seal where it is exhausted through duct 76 to complete the cycle. The system of FIGS. 5 and 6 has the advantage of providing the desired gentle air flow within the air seal without the use of additional fan systems beyond that already in place in the oven system. As with the embodiment of FIGS. 1–4, the air seal of FIGS. 5 and 6 minimizes the temperature gradient from top to bottom of the air seal at the entrance to the seal, thereby minimizing convection currents within the air seal and substantially eliminating the rollover flow of warm air out of the oven and cold air in. And as with the embodiment of FIGS. 1–4, the various parameters of the air exhaust and supply system are determined and regulated in a manner to achieve the desired substantial elimination of the vertical temperature gradient at the entrance to the air seal.

The invention air seals will be seen to provide a simple and effective way of minimizing the escape of heated air from the open ends of the oven system and thereby minimizing the pollution of the environment of the associated building by the oven system, and the invention seals accomplish these results without creating any disturbing air flow within the oven such as would tend to mar the wet finish coat of the articles being processed.

Although preferred embodiments of the invention have been illustrated and described in detail, it will be apparent that various changes may be made in the disclosed embodiments without departing from the scope or spirit of the invention. For example, although the invention air seals are particularly suited for use as a prefix to the entry end of an oven system, since concerns about protecting the still wet finish coat on the articles is greatest at that end, it will be understood that an invention seal 20 may also be provided at the discharge or exit end of the oven complex with similar advantageous results.

We claim:

1. A method of reducing the flow of hot air out of the entry end of an elongated paint curing oven system of the type in which painted articles to be processed are moved longitudinally through an oven and wherein said oven system includes a sealing compartment having a longitudinal length terminating in an entrance and exit, with said exit aligned with the entry to the oven, said method comprising the steps of:

continuously removing heated air from the upper region of said compartment adjacent said compartment exit;

continuously recirculating said heated air to the lower region of said compartment along its longitudinal length;

preventing any high velocity flow of air between said lower and upper regions of said compartment, and preventing any high velocity flow of air across the entrance to said compartment.

2. An apparatus for sealing the entry to a paint curing oven of the type in which painted articles are continuously conveyed through said entry and into said oven, said apparatus comprising:

a compartment having a longitudinal length terminating at an entrance and an exit; said exit being aligned with the entry to said oven, said compartment also having means to accommodate and receive a conveyor to carry said painted articles;

means for withdrawing heated air from an upper region of said compartment adjacent said exit; and air supplying means for recirculating said heated air to a lower region of said compartment along its longitudinal length without creating a high velocity flow of air between said upper and lower regions of said compartment; said air supplying means having a discharge port extending from a point adjacent said entrance to a point adjacent said exit.

3. The sealing apparatus of claim 1 wherein said compartment includes a side wall, and wherein said discharge port extends along a substantial portion of said side wall from a point adjacent said entrance to a point adjacent said exit.

4. The sealing apparatus of claim 2 wherein said discharge port is located to direct said heated air into said lower region below said conveyor.

5. The sealing apparatus of claim 2 wherein said compartment further includes means defining a ceiling panel inclined upwardly from said entrance toward said exit.

6. The sealing apparatus of claim 2 wherein said compartment further includes means to accommodate a floor conveyor to carry said painted articles.

7. The sealing apparatus of claim 2 wherein said discharge port is configured and positioned so as not to direct a high velocity flow of air across said compartment entrance.

8. The sealing apparatus of claim 2 wherein said discharge port comprises an elongated passageway in a side wall of said compartment, said passageway being configured and positioned so as not to direct a high velocity flow of air across said compartment entrance.

* * * * *